United States Patent [19]

Nelson

[11] 4,373,752

[45] Feb. 15, 1983

[54] WELL CASING HANGER ASSEMBLY

[75] Inventor: Norman A. Nelson, Houston, Tex.

[73] Assignee: Samuel Putch, Houston, Tex. ; a part interest

[21] Appl. No.: 289,935

[22] Filed: Aug. 4, 1981

Related U.S. Application Data

[63] Continuation of Ser. No. 75,568, Sep. 14, 1979, abandoned.

[30] Foreign Application Priority Data

Oct. 6, 1978 [GB] United Kingdom ..... 39590/78

[51] Int. Cl.[3] ..... F16L 21/00

[52] U.S. Cl. ..... 285/141; 285/307; 285/321; 166/208

[58] Field of Search ..... 285/141, 321, 307, 317; 166/208

[56] References Cited

U.S. PATENT DOCUMENTS

| | | | |
|---|---|---|---|
| 3,472,530 | 10/1969 | Fowler | 285/141 X |
| 3,592,489 | 7/1971 | Baugh | 285/321 X |
| 3,893,747 | 7/1975 | Nelson et al. | 285/141 |
| 3,918,747 | 11/1975 | Putch | 166/208 |
| 4,167,970 | 9/1979 | Cowan | 285/141 X |
| 4,167,971 | 9/1979 | Cowan | 285/141 X |
| 4,181,331 | 1/1980 | Cowan | 285/141 |
| 4,232,889 | 11/1980 | Putch | 285/141 |

*Primary Examiner*—Dave W. Arola

[57] ABSTRACT

A well casing hanger assembly for releasably connecting first and second well casings to and from each other in a well by longitudinal movement of the first member. The first member includes an annular recess in its peripheral surface and a stop shoulder is positioned at each end of the recess and a resiliently expandable and contractible locking ring is positioned in the recess for engagement with a locking notch on the second member. A protrusion is positioned in the recess and initially coacts with an opening in the locking ring. An improved releasable holding means is provided for initially preventing the locking ring from moving axially on the first member until the locking ring expands and engages the second member. The releasable holding means includes first and second tapered surfaces on the first member for engaging and restraining downward movement of the first member relative to the locking ring until the locking ring expands into the locking notch and thereafter act to positively force the locking ring into the set position. The locking ring may include coacting tapered surfaces for coacting with the first and second tapered surfaces and may include a C-shaped release ring positioned in the opening which includes a tapered surface coacting with the second tapered surface.

2 Claims, 8 Drawing Figures

WELL CASING HANGER ASSEMBLY

This is a continuation of application Ser. No. 75,568, filed Sept. 14, 1979, now abandoned.

BACKGROUND OF THE INVENTION

It is generally old, as shown in U.S. Pat. No. 3,893,717, to support an inner casing in a well of an outer casing by means of a resiliently expandable and contractible locking ring. The present device is directed to an improved releasable holding means for initially preventing the locking ring from moving axially on the casing hanger until the locking ring expands and engages into a locking notch on the second member and thereafter provides a forced expansion of the locking ring into engagement in the locking notch.

SUMMARY

The present invention is directed to a well hanger assembly for connecting first and second tubular members, such as casing together, which includes a resiliently expandable and contractible C-shaped locking means which is radially and axially movable on the first member for engagement between the second member and a stop shoulder in which improved releasable holding means are provided for holding the locking means out of engagement with the stop shoulder until the locking notch is reached.

Yet a still further object of the present invention is the improvement in releasable holding means for initially preventing the locking means for moving axially on the first member until the locking means expands and engages the second member and in which the releasable holding means forces expansion of the locking means outwardly into engagement with the locking notch.

Still a further object of the present invention is the provision of releasable holding means which includes a first tapered surface extending upwardly and outwardly from the first member at a position below the upper stop shoulder and a second tapered surface positioned on the bottom of a protrusion on the first member and which extends outwardly and upwardly thereby restraining downward movement of the first member relative to the locking means until the locking means expands outwardly into the locking notch. In addition, the tapered surfaces act on the locking means to positively force outward expansion of the locking means into the locking notch.

A still further object of the present invention is the provision of coacting tapered surfaces on the locking means for coacting with the first and second tapered surfaces on the first member.

Yet a further object is the provision of a C-shaped release spring positioned between the locking means and a protrusion on the first member which includes a tapered surface coacting with a tapered surface on the protrusion for releasably holding the locking means from moving axially until the locking means expands and engages the second member and which is recockable.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 1B shows the casing hanger locking ring being expanded outwardly into engagement with a locking notch, FIG. 1C shows the casing hanger assembly in the set position, FIGS. 2A and 2B are fragmentary elevational views, partly in cross section, of another form of the casing hanger assembly of the present invention in which FIG. 2A shows the casing hanger in its collapsed position being run inside of a casing, FIG. 2B showing the casing hanger assembly in the set position.

DESCRIPTION OF THE PREFERRED EMBODIMENT

Figure 1A:
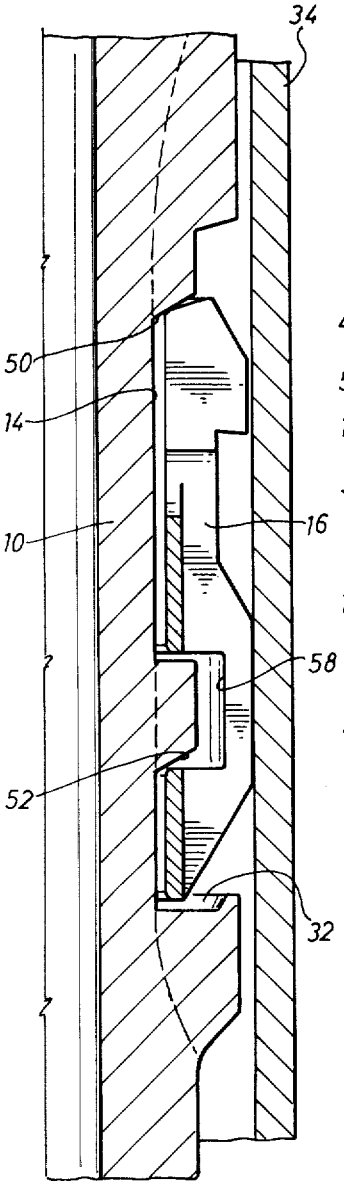
FIGS. 1A, 1B and 1C are fragmentary elevational views, partly in cross section, of a casing hanger and is shown in FIG. 1A in its collapsed position being run inside of a casing.
Figure 1B:
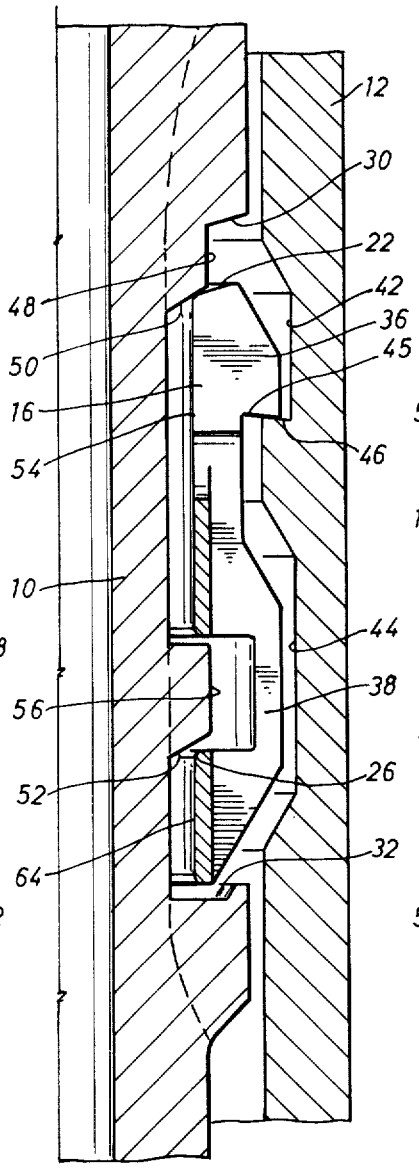
Figure 1C:
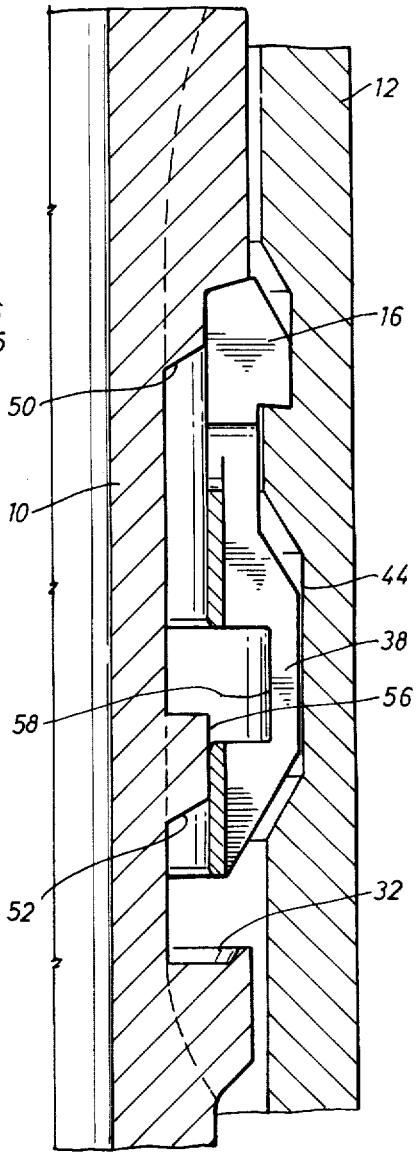

Referring now to the drawings, particularly to the embodiment of FIGS. 1A, 1B and 1C, a first inner casing hanger 10 is shown which is desired to be connected and released from a second outer casing hanger 12, both of which are tubular members in which the casing hanger 10 is supported suspending a string of casing in a well from the outer casing hanger 12. The casing hanger assembly 10 includes an annular recess 14 in its outer peripheral surface for carrying an expandable outwardly biased and resiliently contractible spring locking means, generally indicated by the reference numeral 16. The locking means 16 may be of any suitable type, such as illustrated in U.S. Pat. No. 3,893,717, and preferably is a C-shaped spring locking means which is resiliently urged outwardly but may be contracted into the recess 14.

The casing hanger assembly 10 is provided with an upper generally radially extending stop shoulder 30 at the top of the recess 14 and a lower radially extending stop shoulder 32 at the bottom of the recess 14. The locking means 16 is axially slideable in the recess 14 between the upper stop shoulder 30 and the lower stop shoulder 32. The recess 14 supports the locking means 16 and allows the locking means 16 to contract inwardly into the recess 14 as the hanger assembly 10 is moved downhole through a casing 34 as best seen in FIG. 1A. The locking means 16 includes an upper locking portion 36 and a lower key portion 38 for coacting with the locking notch in the casing hanger assembly 12, as best seen in FIGS. 1B and 1C. The locking notch includes an upper locking portion 42 and a lower key receiving portion 44. The key portion 38 prevents the locking portion 36 of the locking means 16 from expanding outwardly and inadvertently engaging various shoulders in the well casing 34 until the key 38 is located adjacent the key receiving portion 44. The locking notch 42 includes a hanger shoulder 46 which extends inwardly towards the casing hanger 10 for coacting with the engaging shoulder 45 on the locking portion 36 of the locking means 16.

The recess 14 includes a locking shoulder 48 on the first casing hanger assembly 10 below and adjacent the first stop shoulder 30 and a tapered shoulder 50 below the locking shoulder 48. The locking portion 36 of the locking means 16 includes a tapered surface 22 which coacts with the tapered shoulder 50 to assist in moving the locking ring 16 outwardly and in and to engagement with the locking notch 40 on longitudinal downwardly movement of the casing hanger assembly 10 relative to the locking means 16 when the locking means 16 engages the casing hanger assembly 12 as best seen in FIG. 1B. However, the tapered surface 22 also acts as a releasable holding means for initially preventing the locking means 16 from moving axially on the hanger 10 and into engagement with the locking shoulder 30 until the position shown in FIG. 1B is reached. A locking surface 54 is provided on the backside of the locking means 16 adjacent its upper end for coaction with the locking shoulder 48 for maintaining the locking means 16 in the expanded and locked position in the locking notch as best seen in FIG. 1C whereby the casing hanger assembly 10 may be connected to and suspended from the casing hanger hanger assembly 12 so long as weight is exerted downwardly on the casing hanger assembly 10.

A protrusion which may include a second locking shoulder 56 is positioned in the recess 14 and connected to the casing hanger assembly 10 and positioned between the stop shoulders 30 and 32 and extends radially outward from the recess 14 as far as the first locking shoulder 48 and includes a tapered surface 52 extending from the recess 14. A receiving notch 58 is provided in the backside of the locking means 16 which initially coacts with the second locking shoulder 56 for allowing the locking means 16 to be retracted into the recess 14. It is to be noted that the coaction between the tapered surface 52 and the tapered surface 26 on the locking means 16 restricts the actual movement of the locking means 16 as the casing hanger assembly 10 is moved downhole, but allows the expansion of the locking means 16 when the locking means 16 becomes properly aligned with the notches 42 and 44, as best seen in FIG. 1B, and in addition assist in moving the locking means 16 outwardly and into engagement with the locking notch on longitudinal downward movement of the casing hanger 10 relative to the locking means 16. In FIG. 1C it is to be noted that the second locking shoulder 56 engages and contacts a lower locking surface 64 on the back of the locking means 16 and prevents the locking means 16 from cocking and additionally locks the locking means 16 into the locked position.

The casing hanger assembly 10 may be easily releaseed and removed from the casing hanger assembly 12 by an upward longitudinal movement of the casing hanger 12 which will allow the locking means 16 to be moved axially downward and the locking means 16 rides down the tapered surfaces 50 and 52 and continued upward pull of the hanger body 10 allows further contraction of the locking means 16 so that it may be pulled upwardly through the outer casing 34 as shown in FIG. 1A.

Other and further modifications may be provided as best seen in FIGS. 2A and 2B, and 3A, 3B and 3C where like character references refer to like parts with the addition of the suffixes "100" and "200".

Figure 2A:
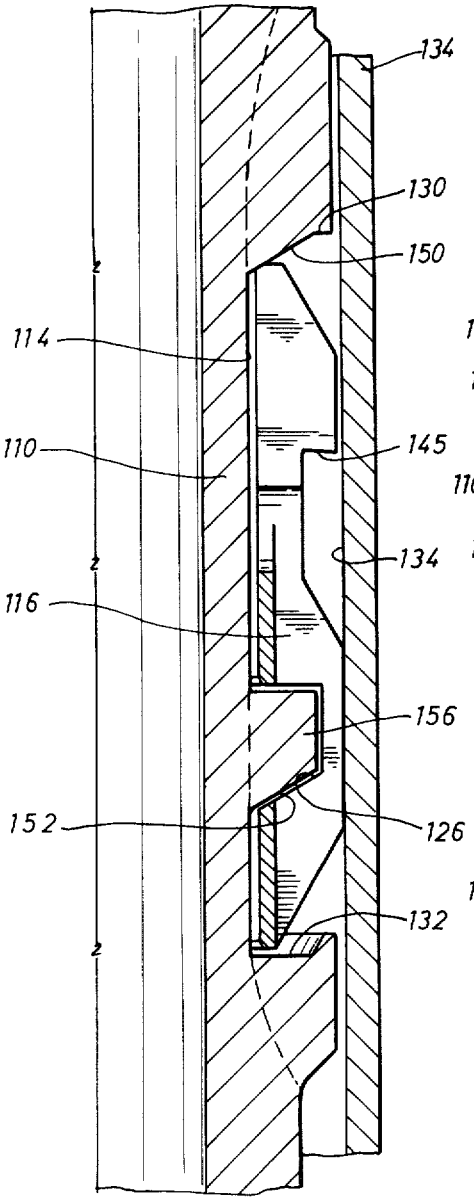
Figure 2B:
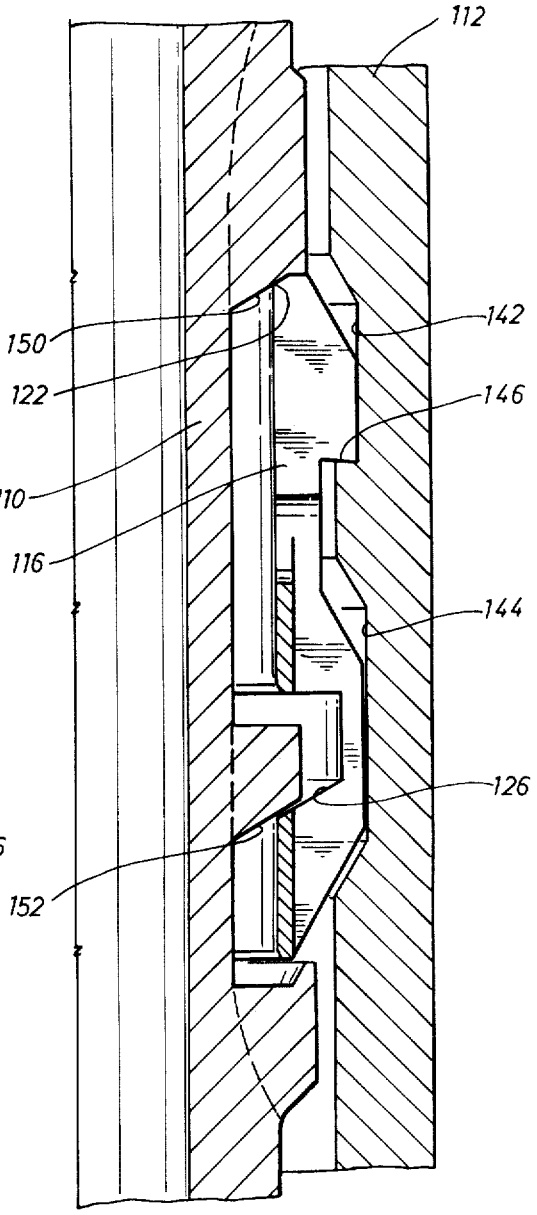

Referring now to FIGS. 2A and 2B, another embodiment is illustrated in which the backup or locking shoulders are omitted. Referring to FIG. 2A, the hanger assembly 110 is shown in the collapsed position while being run through an outer casing 134. Thus, the hanger body 110 carries the locking ring 116 which in turn is retracted in the recess 114 and the tapered surfaces 150 and 152 releasably hold the locking means 116 out of engagement with the upper stop shoulder 130 while in the running position of FIG. 2A. Upon reaching the notches 142 and 144 in the outer hanger body 112, the locking means 116 resiliently expands to mate with the profiles of notches 142 and 144 and the weight of the hanger body 110 causes the upper tapered surface 122 to cam against and ride up the tapered surface 150 of the hanger body 10. Similarly, the lower tapered surface 126 on the locking means 116 may ride up the lower tapered surface 152 of the hanger 10 until the locking means 16 comes to rest in the fully set position as best seen in FIG. 2B. Thus, the tapered surfaces 150 and 152 on the hanger body 10 coact with the tapered surfaces 122 and 126 of the locking ring 116 to provide an initial means for preventing the locking means 116 from moving axially on the first member 10 until the locking means 116 expands and engages the casing hanger assembly 112 at which time the coacting tapered surfaces insure that the locking means 116 will be forced out at both its top and bottom to insure setting of the hanger assembly 110 in the hanger assembly 112. The hanger assembly 110 may be removed from the outer hanger assembly 112 by simply pulling up upon the hanger body 110 whereby the hanger ring 116 contracts to the collapsed position as best shown in FIG. 2A.

Figure 3A:
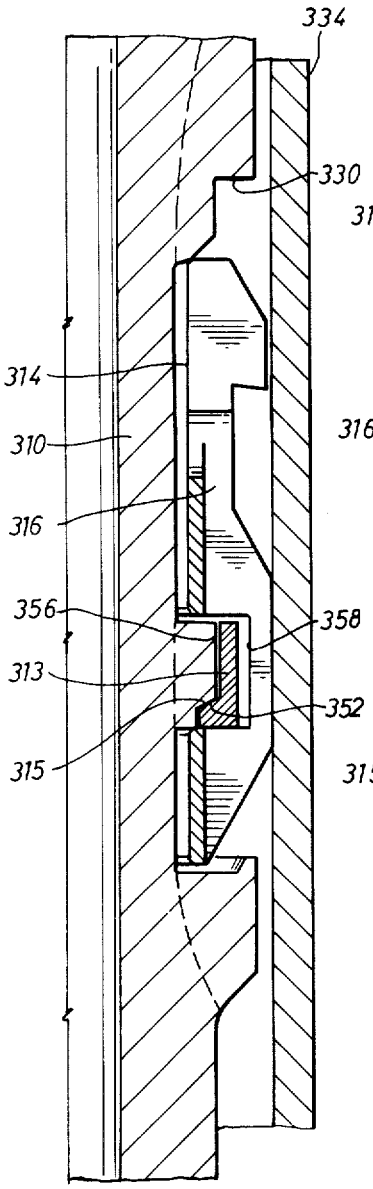
FIGS. 3A, 3B and 3C are fragmentary elevational views, partly in cross section, of the preferred form of the present invention in which the casing hanger is shown in the collapsed position in FIG. 3A, and the locking ring is shown in an expanded position engaging the locking notch in FIG. 3B, and the casing hanger is shown in a set position in FIG. 3C.
Figure 3B:
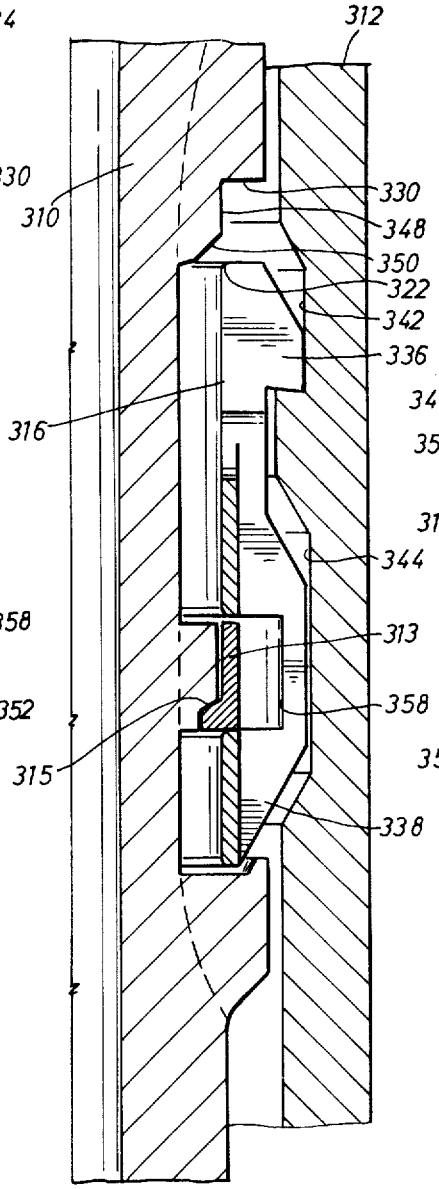
Figure 3C:
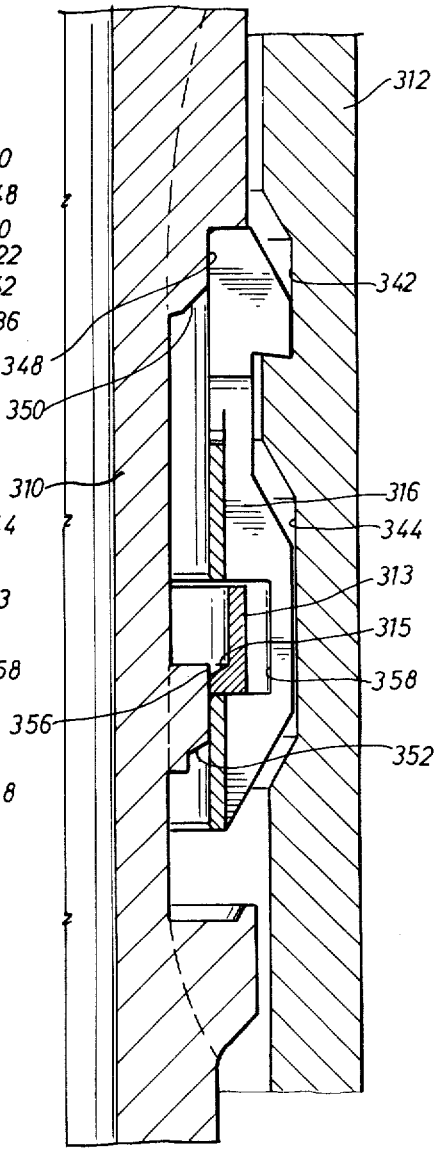

Referring now to FIGS. 3A, 3B and 3C, the preferred embodiment of the present invention is best seen which includes a release ring 313 which like locking means 316 is circular with a split to form a "C" cross section but which is resiliently urged inwardly. The release spring 313 is formed with a tapered surface 315 which initially engages, as best seen in FIG. 3A, the tapered surface 352 on the shoulder 356 of the hanger 310. Thus, when the locking means 316 is in the collapsed position, while being run through the outer casing 334, as best seen in FIG. 3A, the release spring 313 is positioned on the outer periphery of the shoulder 356 and in the opening 358 of the locking means 316 with the tapered surface 315 coacting with the tapered surface 352 thereby holding the locking means 316 stationary in axial relation to the hanger assembly 310 thereby preventing the locking means 316 from engaging the locking shoulder 330.

As best seen in FIG. 3B, the locking ring 316 expands outwardly into engagement with the mating profiles 342 and 344 as the hanger assembly 313 is moved into the hanger assembly 312 and at the same time moves outwardly relative to the release ring 313. Continued downward movement of the hanger assembly 310 forces the release spring 313 upwardly and outwardly relative to the shoulder 356 by virtue of the camming action between the tapered surfaces 315 and 352 as best seen in FIG. 3C. Consequently, the hanger assembly 310 moves downwardly within the locking means 316 and the tapered surfaces 350 and 352 assist in camming the locking means 316 outwardly into the locked position and the locking shoulders 348 and 356 engage the backside of the locking means 316 to hold it in the set or locked position. Advantageously, the well casing hanger of the embodiment can be recocked downhole simply by exerting an upward pull on the hanger assembly 310 to reverse the steps and place the hanger in the position shown in FIG. 3A with the release ring 313 back into the position on the shoulder 356 and the locking means 316 retracted into the recess 314.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts may be made which will readily suggest themselves to those skilled in the art and which are encompassed within the spirit of the invention and the scope of the appended claims.

What is claimed is:

1. In an assembly for connecting first 310 and second 312 tubular members to and from each other in a well by longitudinal movement of the first member 310 relative to second member 312, said first member 310 including an annular recess 314 in its peripheral surface and a protrusion intermediate the ends of recess 314, generally radially extending upper 330 and lower stop shoulders on said first member 310 at respectively the top and bottom of recess 314, an upper locking shoulder 348 on said first member 310 below and adjacent stop shoulder 330, a lower locking shoulder 356 on said protrusion of first member 310, a resiliently expandable and contractable locking means 316 positioned in said recess 314, said locking means 316 being radially and axially moveable on first member 310 between said upper 330 and lower stop shoulders, an opening 358 in locking means 316 for receiving said protrusion of first member 310 when locking means 316 is contracted, an upper locking surface and a lower locking surface on said locking means 316 for coacting respectively with said upper locking shoulder 348 and said lower locking shoulder 356 when said locking means 316 is in an expanded position, an upper locking portion 336 on the outer periphery of said locking means 316, an upper locking notch 342 in said second member 312 for receiving said upper locking portion 336 upon expansion of said locking means 316 in a manner to prevent further downward movement of locking means 316 and to allow upward retraction of locking means 316 from locking notch 342; the improvement comprising: an expandable and contractable, circular release spring 313 having a split to form a "C" shape, said release spring 313 positioned about the periphery of said protrusion of first member 310 and within said opening 358 of locking means 316, said release spring, locking means and protrusion having coacting means thereon for preventing axial movement of locking means 316 relative to first member 310 when locking means 316 is in a contracted position with said protrusion positioned in said opening and for expanding said release spring into said opening allowing said locking means 316 and release spring 313 to move outwardly and upwardly relative to first member 310 upon locking portion 336 encountering locking notch 342.

2. The apparatus of claim 1 wherein said coacting means on said circular release spring 313 includes an upwardly and outwardly directed tapered surface 315 on its inner periphery, and wherein said coacting means on said protrusion of first member 310 includes an upwardly and outwardly tapered surface 352 on its lower end for coacting with said tapered surface 315 to maintain said release spring 313 in position about the periphery of said protrusion of first member 310 when locking means 316 is in a contracted position and allowing movement of said release spring 313 upwardly and outwardly upon engagement of locking portion 336 with locking notch 342 and the subsequent expansion and upward movement of locking means 316.

* * * * *